US005915581A

United States Patent [19]

Pfirrmann, Jr. et al.

[11] Patent Number: 5,915,581

[45] Date of Patent: Jun. 29, 1999

[54] COMPARTMENTAL CONTAINER FOR SERVING FOOD PRODUCTS

[75] Inventors: F. Joseph Pfirrmann, Jr., Covington, Ky.; Jeffery L. Kalebain, Cincinnati, Ohio; Thomas A. Messina, Edgewood, Ky.

[73] Assignee: Boston Chicken, Inc., Golden, Colo.

[21] Appl. No.: 08/647,779

[22] Filed: May 15, 1996

[51] Int. Cl.[6] ..... B65D 1/24; B65D 6/00; B65D 43/10

[52] U.S. Cl. ..... 220/4.21; 220/555; 220/784; 220/793

[58] Field of Search ..... 220/4.21, 575, 220/4.24, 4.23, 556, 555, 781, 784, 793, 805, 799, 324, 326, 786, 780, 788; 206/511, 551; 312/284, 285

[56] References Cited

U.S. PATENT DOCUMENTS

| | | | |
|---|---|---|---|
| 2,096,825 | 10/1937 | Roman . | |
| 2,641,912 | 6/1953 | Lawler . | |
| 3,001,665 | 9/1961 | Tomarin . | |
| 3,107,027 | 10/1963 | Hong . | |
| 3,163,310 | 12/1964 | Blakslee | 215/305 |
| 3,595,425 | 7/1971 | Eicholtz et al. . | |
| 3,633,785 | 1/1972 | Cyr et al. . | |
| 3,708,086 | 1/1973 | Colato | 220/575 |
| 3,754,640 | 8/1973 | Bridges . | |
| 3,799,386 | 3/1974 | Madalin et al. . | |
| 3,845,875 | 11/1974 | Douglas et al. | 220/556 |
| 3,933,295 | 1/1976 | Congleton | 220/4.24 X |
| 3,938,688 | 2/1976 | Ryan | 220/556 X |
| 3,967,731 | 7/1976 | Boduch | 206/511 X |
| 4,294,371 | 10/1981 | Davis | 220/4.24 |
| 4,494,650 | 1/1985 | Cullen | 220/788 X |
| 4,535,889 | 8/1985 | Terauds | 220/784 X |
| 4,660,716 | 4/1987 | McMahon et al. . | |
| 4,684,024 | 8/1987 | Ebrahim et al. | 220/324 X |
| 4,687,117 | 8/1987 | Terauds | 220/781 |
| 4,805,797 | 2/1989 | Natori | 220/793 X |
| 4,915,251 | 4/1990 | Payne | 220/4.23 X |
| 5,518,133 | 5/1996 | Hayes et al. | 220/793 |

*Primary Examiner*—Stephen Castellano
*Assistant Examiner*—Niki M. Eloshway
*Attorney, Agent, or Firm*—Rudnick & Wolfe

[57] ABSTRACT

A two-piece container including a plate having a peripheral rim and a cover having a peripheral flange. The flange of the cover has a depending portion adapted to overlappingly engage the rim of the plate in a releasable interlocking relationship. In one aspect of the invention, an indexing cut-out portion is formed in either the plate rim or the cover flange, and an indexing protrusion extends inwardly from the other of the plate rim and cover flange. To facilitate alignment of the cover and the plate during releasable attachment of the cover to the plate, the indexing protrusion is configured to engage the indexing cut-out portion. In another aspect of the invention, the plate has a bottom, a side wall extending upwardly from a periphery of the bottom, and a raised rib-like partition extending upwardly from the bottom to define separate plate compartments for holding and separating food items thereon. The partition has an inverted V-shape with a rounded apex. The cover has a top wall provided with a depending divider for likewise dividing the cover into separate compartments complementary to the compartments defined in the plate. The divider extends a sufficient distance to engage the plate partition when the cover is attached to the plate to thereby define separate food compartments. To inhibit liquid from transferring between the food compartments, the divider is generally V-shaped with an apex defining a channel adapted to receive and mate with the rounded apex of the plate partition. In another aspect of the invention, the dividers of the cover are configured with a recess defining a seat and side walls for receiving and holding an item externally of the cover.

9 Claims, 5 Drawing Sheets

COMPARTMENTAL CONTAINER FOR SERVING FOOD PRODUCTS

FIELD OF THE INVENTION

The present invention relates generally to containers or receptacles for food products, and, more particularly, to a compartmentalized "carry-out" container which provides easy and quick assembly/disassembly and facilitates the transport of food entrees and side items from a restaurant to a desired eating location without mixing the food items in separate compartments.

BACKGROUND OF THE INVENTION

Various types of "carry-out" containers are known for transporting food products from a grocery store or restaurant to the location where the food is to be consumed. These types of containers typically include a lower plate which holds a food product, with a removable cover releasably attached to the plate. Some of these containers are also provided with separate compartments to segregate food items during storage and transport. Typically, the cover is divided into a plurality of compartments which correspond to a plurality of compartments formed in the plate. However, one problem with compartmentalized containers is the difficulty in aligning the compartments of the cover and the plate. This difficulty is especially apparent in "fast-food" type restaurants, where speedily delivering the food product to the customer is of utmost importance. Thus, it remains desirable to provide a container that facilitates quick alignment of the cover and plate compartments, as well as easy attachment of the cover to the plate after the desired food products, whether they be entrees or side items, have been placed in the appropriate compartments on the plate.

Another problem with some compartmentalized containers is the difficulty of detaching the cover from the plate. The covers of such containers are often attached to the plate by a crimped or snap-over engagement around the entire periphery of the container. Attempts have been made to provide finger slots or pull-tabs to allow the placement of a finger between the cover and the plate. However, there remains a need for an improved pull-tab configuration that provides quick and easy detachment of the cover from the plate by the consumer after the container has been transported to the desired location for consumption.

In some compartmentalized containers, the mere "contact" engagement of the cover partitions with the corresponding plate partitions may still allow liquid food products such as gravy to escape from one food compartment into the adjacent food compartment. It therefore is desirable to configure the cover partitions and plate partitions to inhibit the passing of liquid therebetween. At the same time, it is desirable to provide the partitions with sufficient structure to inhibit flexing of the container during transport, thereby preventing spilling and ensuring a successful transport of segregated food products to the home of a consumer.

It is not uncommon for a purchaser to request extra gravy or other liquid products to enhance the flavors and taste of the food products in the container. The ability of the purchaser to carry both the plate and an extra container of gravy tends to be cumbersome, especially when more than two serving plates are required to transport the food products. Thus, it is desirable to provide a container that facilitates transport of extra containers external to the main containers.

Other desirable features of a compartmentalized container are to provide feet for facilitating stacking of assembled containers, and to configure the cover with a recess for receiving and holding an item externally of the cover.

SUMMARY OF THE INVENTION

In view of the above, and in accordance with one aspect of the present invention, there is provided a two-piece container including a plate having a bottom, a side wall extending upwardly from the bottom, and a peripheral rim extending radially outwardly from the periphery of the side wall. A cover has a top wall, a side wall depending from the top wall, and a peripheral flange extending outwardly from the periphery of the side wall. The flange of the cover also has a depending portion adapted to overlappingly engage the rim of the plate in a releasable interlocking relationship.

In one aspect of the invention, an indexing cut-out portion is formed in the peripheral rim of the plate, and a hollow pull-tab extends outwardly from the depending portion of the peripheral flange of the cover. The hollow pull-tab is configured to engage the indexing cut-out portion to thereby facilitate alignment of the cover and the plate during releasable attachment of the cover to the plate. In addition, the hollow pull-tab is provided with sufficient space to receive the finger of a person applying an upward pressure to the peripheral flange of the cover to thereby facilitating loosening and removal of the cover.

In another aspect of the invention, the plate has a raised rib-like partition extending upwardly from the bottom to define separate plate compartments for holding and separating food items thereon. The partition has an inverted V-shape with a rounded apex. The top wall of the cover is also provided with a depending divider for likewise dividing the cover into separate compartments complementary to the compartments defined in the plate. The divider extends a sufficient distance to engage the plate partition when the cover is attached to the plate to thereby define separate food compartments. To inhibit liquid from transferring between the food compartments, the divider is generally V-shaped with an apex defining a channel adapted to receive and mate with the rounded apex of the plate partition.

In yet another aspect of the invention, the dividers of the cover are configured with a recess defining a seat and side walls for receiving and holding an item externally of the cover. Also, to promote stacking and prevent shifting of the containers, the bottom of the plate has an arcuate ridge depending therefrom adjacent the periphery of the bottom. The top wall of the cover has a recessed peripheral section adapted to receive the arcuate ridges of another container bottom.

In a preferred embodiment of the invention, the container is divided into three separate compartments—one for an entree and two for side dishes. Also, the peripheral rim of the plate has a raised outermost ridge for mating engagement with an outermost recess formed in the cover flange. This provides a secure interlocking relationship between the cover and the plate, and inhibits liquid from passing therebetween.

The present invention provides significant advantages over other compartmental containers. A compartmental container is provided that facilitates quick alignment of the cover and plate compartments, as well as easy attachment and detachment of the cover to the plate. The cover and plate are configured to inhibit the passing of liquid out of the container or between compartments. Moreover, the container of the present invention provides feet for facilitating stacking, and is configured with a recess in the cover for receiving and holding an item externally of the cover.

The present invention, together with further objects and advantages, will be best understood by reference to the following detailed description taken in conjunction with the accompanying drawings.

DETAILED DESCRIPTION OF THE PREFERRED EMBODIMENT(S)

Figure 1:
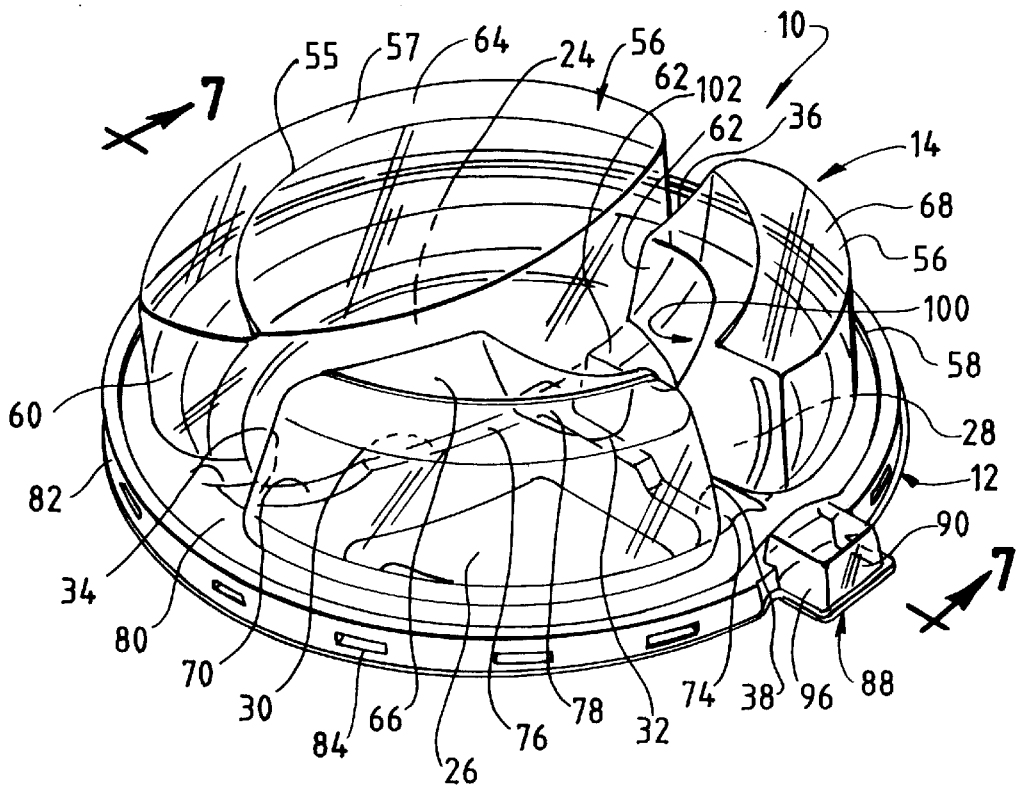
FIG. 1 is a perspective view of the present invention showing a cover releasably attached to a plate to form a compartmentalized container.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Figure 2:
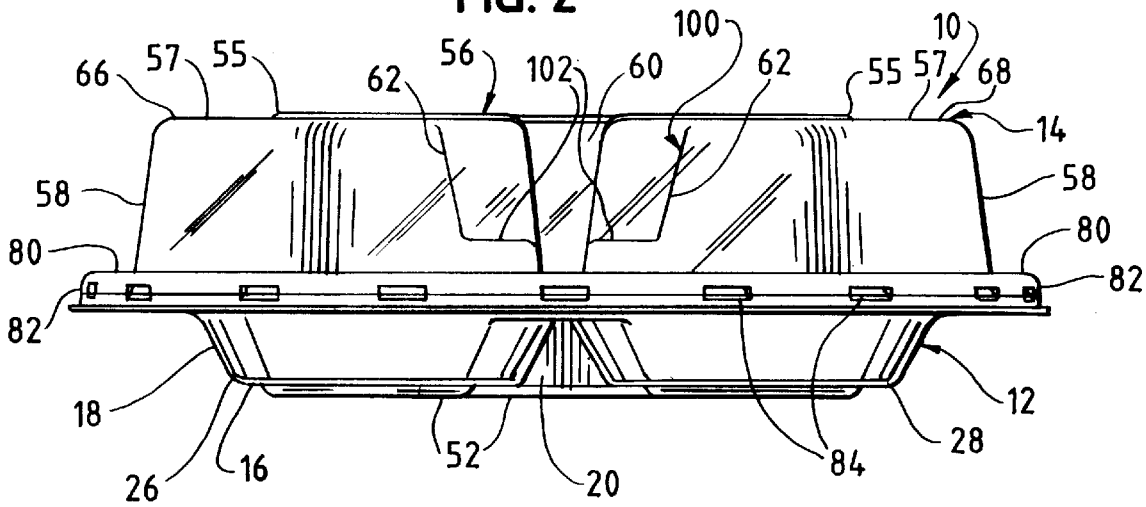
FIG. 2 front view of the container shown in FIG. 1.

Referring now to the drawings, wherein like reference numerals refer to like parts throughout the several views, there is shown in FIGS. 1 and 2 an assembled "carry-out" container or receptacle 10 configured with a plurality of cavities or compartments for respectively holding different food products. For purposes of clarity, terms of orientation such as "depending" and the like will refer to the orientation of the container as shown in FIGS. 1 and 2. In the illustrated embodiment, the container 10 is a two-piece unit including a plate 12 and a removable cover 14.

Figure 3:
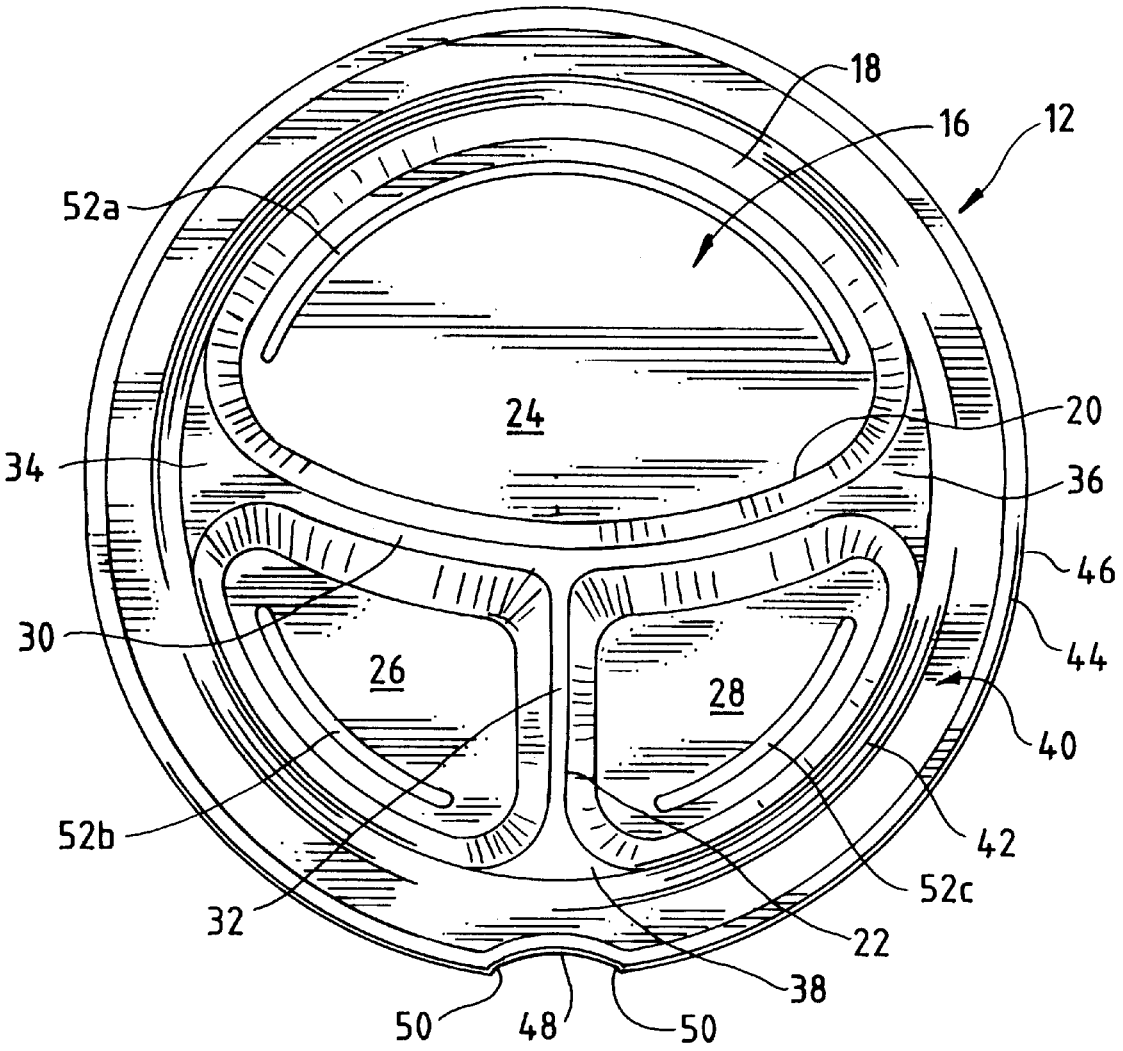
FIG. 3 is a top plan view of the plate illustrating separate compartments and showing a cut-out for receiving a pull-tab.
Figure 4:
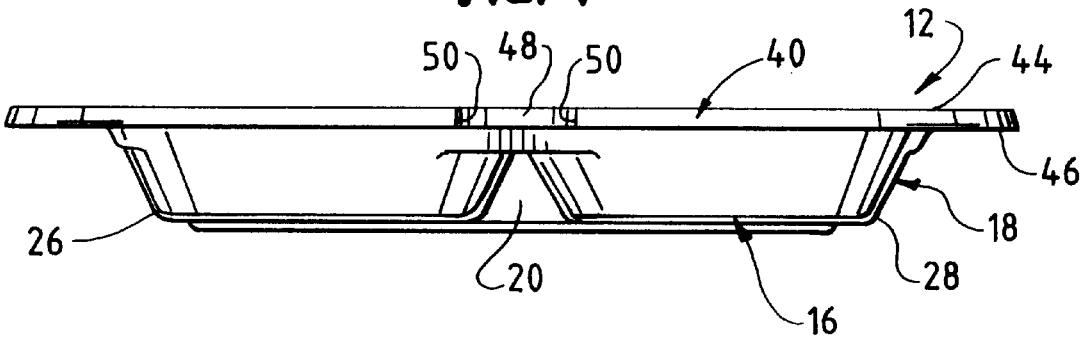
FIG. 4 is a front view of the plate.

As best shown in FIGS. 3 and 4, the plate 12 is configured with a substantially planar circular bottom 16 with an inverted frusto-conically shaped side wall 18 extending upwardly and outwardly therefrom. The side wall 18 can be provided with a plurality of vertical ribs (not shown) to increase the strength of the plate and inhibit flexing. A plurality of raised rib-like partitions 20, 22 extend upwardly from the bottom 16 to define separate plate compartments 24, 26, 28 for holding and separating food items thereon. In a most preferred form of the invention, the partition 20 is oriented in approximately the middle of the plate bottom 16 and arcs lengthwise so that the section 24 is enlarged to provide additional space for placing an entree thereon. The partition 22 is preferably straight lengthwise and interconnects the center of partition 20 to the side wall 18 to define equal size compartments 24, 26 and 28 for placing side items thereon. As will be appreciated, the number and relative size of the compartments can varied without departing from the spirit and scope of the invention. Similarly, the plate 12 can be formed in many different configurations besides the generally circular embodiment shown, such as rectangular, square, oval and the like.

Figure 10:
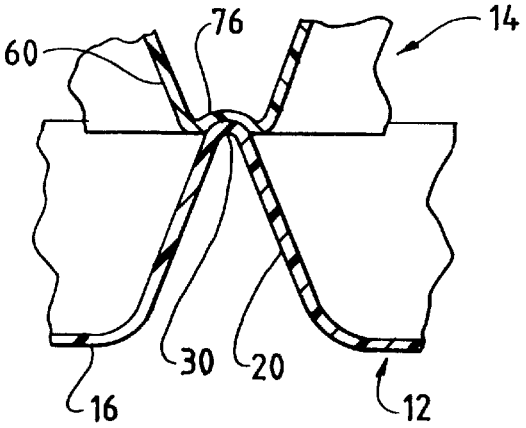
FIG. 10 is a fragmentary enlarged view of the mating engagement of the plate partitions and cover dividers shown in FIG. 7.

As illustrated in FIGS. 3 and 10, the partitions 20 and 22 are preferably constructed as inverted, substantially hollow V-shaped members with rounded apexes 30 and 32. To increase rigidity of the plate and inhibit flexing, the partition apexes are generally flat at lengthwise end portions 34, 36, and 38 extending radially inwardly from the side wall 18. Preferably, the partitions 20 and 22 have a height less than the height of the side wall 18, and the flat end portions 34, 36 and 38 of the partitions 20 and 22 are lower than the rounded apexes 30 and 32.

Figure 7:
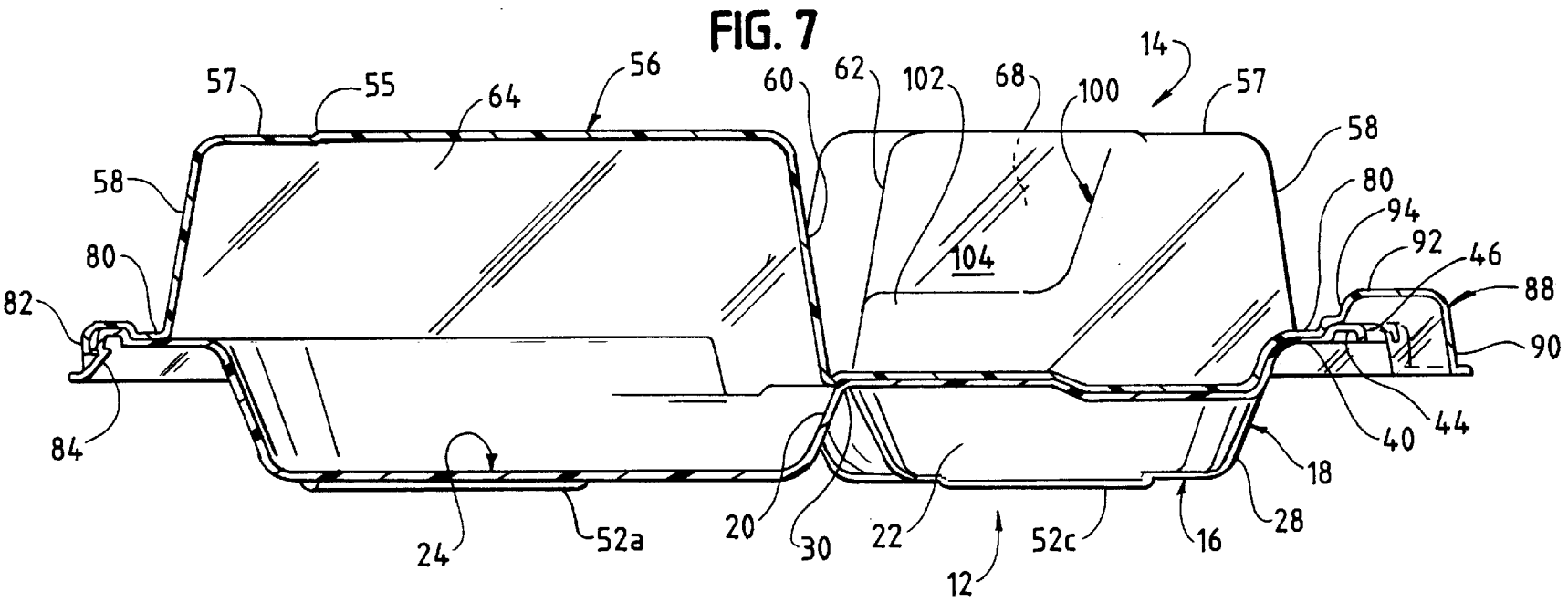
FIG. 7 is a cross-sectional view of the assembled container taken along the line 7—7 in FIG. 1.
Figure 8:
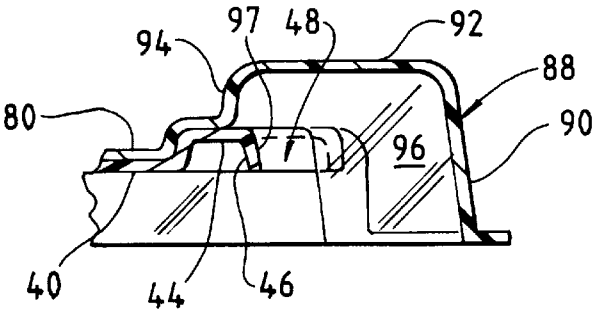
FIG. 8 is a fragmentary enlarged view of the pull-tab arrangement shown in FIG. 7.
Figure 11:
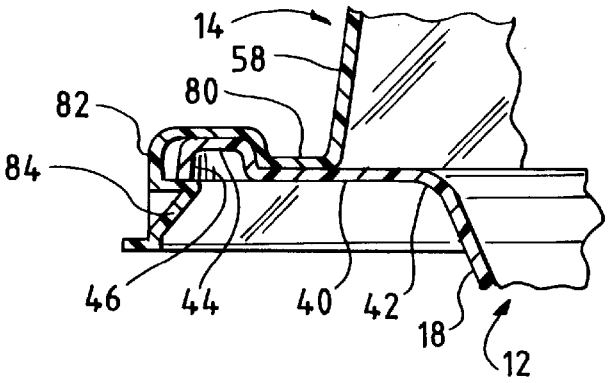
FIG. 11 is a fragmentary enlarged view of the releasable attachment of the cover to the plate as shown in FIG. 7.

The plate 12 is also provided with a circumferential flange or rim 40 extending generally horizontally and radially outwardly from a periphery 42 of the side wall 18. As best shown in FIGS. 7, 8 and 11, the rim 40 has a raised outermost ridge 44 for inhibit the egress of liquids such as gravy or the like as will be discussed in more detail below. The ridge 44 terminates in a downwardly extending lip 46 for releasable attachment of the cover 14 thereto.

Figure 9:
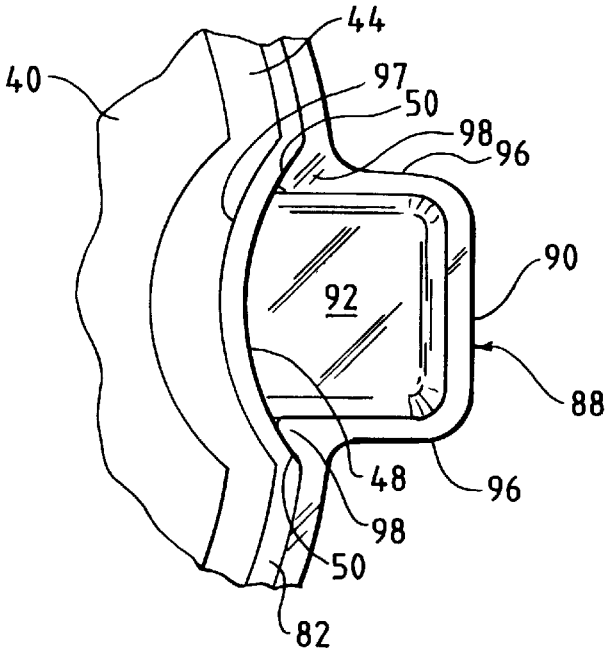
FIG. 9 is a bottom view of the pull-tab arrangement shown in FIG. 8.

As shown in FIG. 9, to allow quick alignment of the cover 14 with the plate 12, a crescent-shaped indexing cut-out portion 48 is formed in the outer edge of the rim 40 of the plate 12. Preferably, the cut-out portion 48 has opposing radial corners 50 configured to mate with an indexing member such as a pull tab formed on the cover 14 which is described in more detail below.

One additional feature of the plate 12 is the provision of arcuate feet or ridges 52 depending from the bottom 16 of the plate 12 to facilitate stacking engagement with the cover 14. Since the bottom 16 of the plate 12 is broken by the compartmental partitions, however, the ridge 52 is broken into separate arcuate portions 52A, 52B and 52C with the same radius of curvature as shown in FIG. 3. When stacked upon another container 10, the ridges 52 are adapted to engage a shoulder 55 of the cover top wall 56 to promote stacking and prevent shifting of containers. Preferably, the shoulder 55 is defined by a recessed peripheral section 57 of the cover top wall 56.

Referring now to FIGS. S and 6, the cover 14 has a compartmentalized shape and size complementary to the shape and size of the plate 12. The cover 14 has a top wall 56 having a circumferential side wall 58 depending therefrom. As with the plate 12, the side wall 18 of the cover 14 can be provided with a plurality of vertical ribs (not shown) to increase the strength of the cover and inhibit flexing. The top wall 56 of the cover 14 is also provided with depending rib-like dividers 60 and 62 for dividing the cover 14 into compartments 64, 66 and 68 complementary to the compartments 24, 26 and 28, respectively, defined in the plate 12. As with the plate compartments, compartment 64 of the cover 14 is somewhat larger than half the volume of the cover 14 for the entree, while the other two compartments 66, 68 are substantially equal in size to accommodate generous portions of side items. The dividers 60 and 62 are generally configured as inverted substantially hollow V-shaped members and extend downwardly a sufficient distance to mate tightly against the corresponding plate partitions 20, 22 when the cover 14 is secured to the plate 12.

The dividers 60, 62 also have lengthwise flat end portions 70, 72, 74 complementary to the flat portions 34, 36 and 38 of the plate partitions 20, 22. However, to accommodate the rounded apexes 30 and 32 of the plate partitions 20, 22, the remaining lengthwise portions of the dividers 60, 62 are provided with channels 76 and 78. Thus, when the cover 14 is secured to the plate 12, the channels 76 and 78 receive and mate with the respective rounded apexes 30, 32 of the plate partitions 20, 22 to thereby inhibiting liquid from transferring between the food compartments. To accommodate the difference in height between the flat portions 34, 36 and 38 and the rounded apexes 30, 32 of the plate partitions 20, 22, the channel portions 76, 78 of the dividers 60, 62 are of a correspondingly different depth than the flat portions 34, 36 and 38.

The cover 14 also has a circumferential flange 80 extending generally horizontally outwardly from the cover side wall 58 for sealing engagement with the rim 40 of the plate 12. As best shown in FIGS. 7, 8 and 11, the flange 80 has a raised outermost recess 82 which mates with the outermost ridge 44 of the plate rim 40 to inhibit liquids such as gravy or the like from escaping between the plate 12 and cover 14. A tight seal is provided because of the non-linear path the liquid would have to travel to escape the container 10.

To releasably attach the cover 14 to the plate 12, the flange 80 of the cover 14 has a depending portion 82 adapted to overlappingly engage the lip 46 of the plate rim 40. A plurality of spaced apart angled tabs 84 extend inwardly from the depending portion 82 to provide a releasable snap-like interlock with the rim 40 of the plate 12. As will be described in more detail below, the material of the plate 12 and cover 14 has the necessary resiliency to provide for such snap-over engagement. Thus, the cover 14 is attached to the plate 12 by merely pressing the cover 14 against the plate 14 until the tabs 84 snap into locking engagement with the rim 40.

To facilitate detachment of the cover 14 from the plate 12, and also to allow quick alignment of the cover 14 with plate 12, a hollow pull-tab 88 extends radially outwardly from the depending portion 82 of the cover flange 80. As illustrated in FIGS. 7–9, the pull-tab 88 is configured with sufficient space to receive the finger or thumb of a person applying an upward pressure to the flange 80 of the cover 14. Preferably, the pull-tab 88 includes a series of interconnected walls, specifically, a front wall 90, a top wall 92, a rear wall 94 and side walls 96. The top wall 92 is at an elevation higher than the flange 80 of the cover 14, and the rear wall 94 terminates adjacent a rear edge 97 of the cut-out portion 48 in the plate 12.

Figure 5:
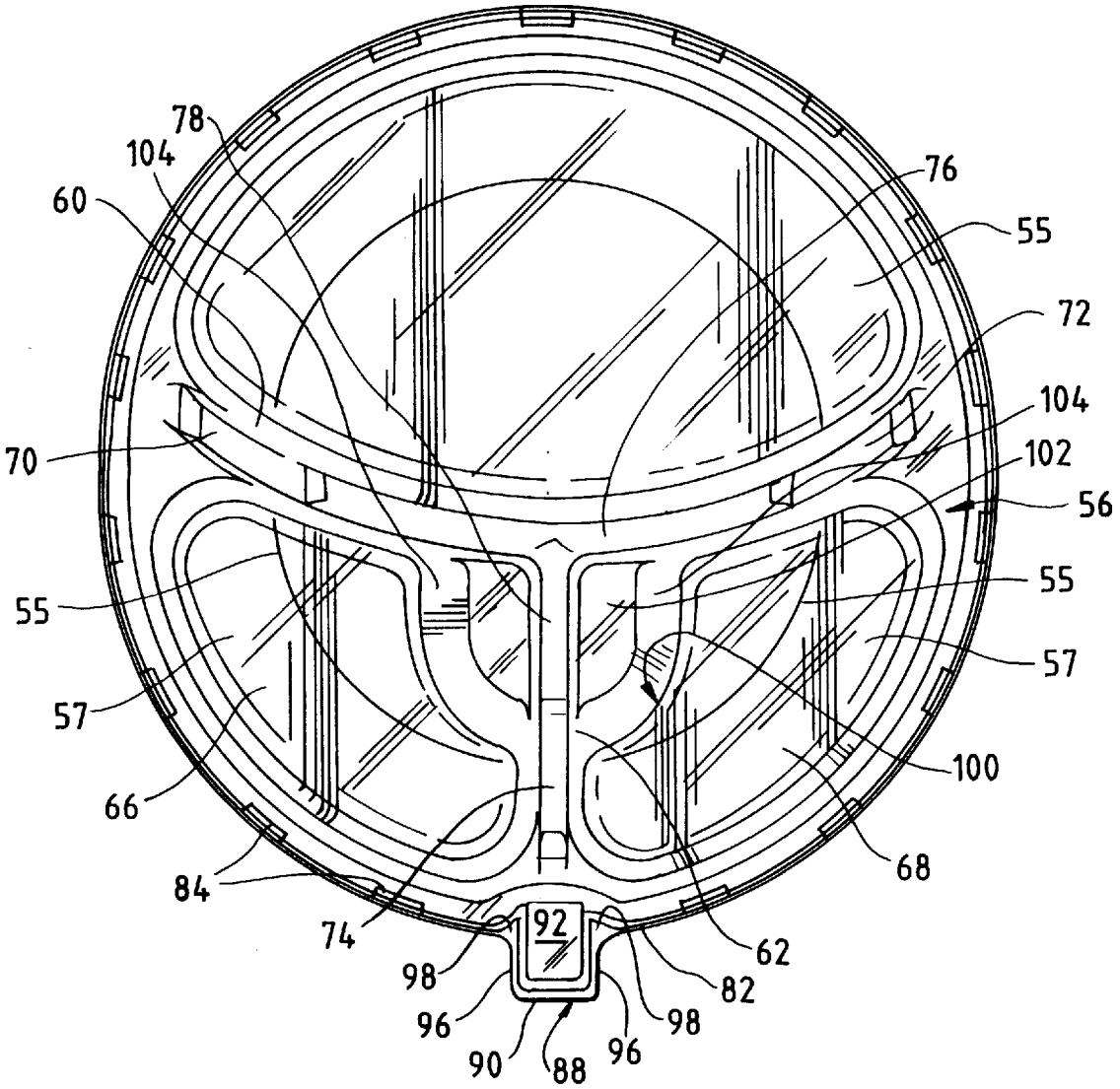
FIG. 5 is a top plan view of the cover illustrating separate compartments corresponding to the compartments of the plate and showing and the pull-tab which operably engages the cut-out in the plate.
Figure 6:
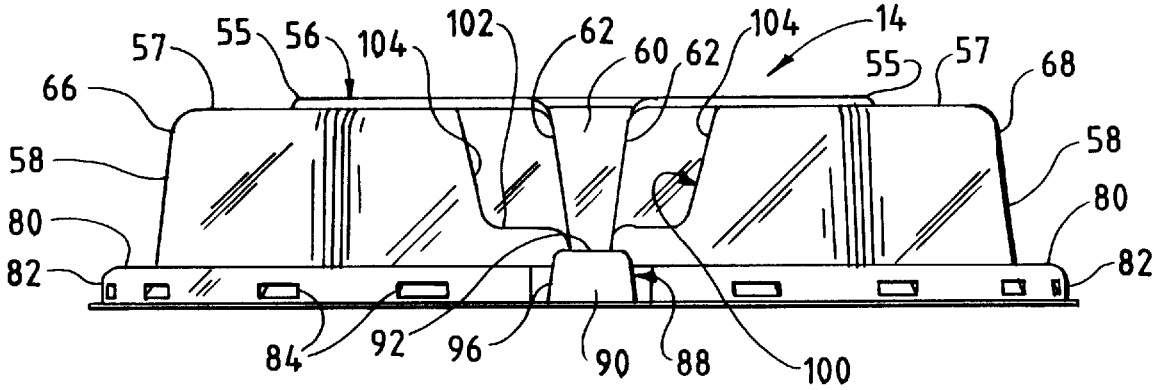
FIG. 6 is a front view of the cover.

The pull-tab 88 is also configured to operably engage the indexing cut-out portion 48 in the rim 40 of the plate 12. In particular, and as shown in FIGS. 5 and 9, the side walls 96 of tabs 88 extend inwardly past the depending portion 82 of the cover flange 80 to act as spaced apart projections 98 that operably engage the opposing radial corners 50 of the cut-out portion 48 of the plate rim 40. Preferably, operable engagement of the angled projections 98 with the radial comers 50 positively influences the cover 14 to the indexed position when the cover 14 is rotated relative to the plate 14. Thus, the desired food products can be placed in the appropriate compartments of the container 10, and the cover 14 can be quickly positioned so that the cover compartments 64, 66 and 68 are aligned with the complementary plate compartments 24, 26 and 28. The container 10 can then be transported to another location while maintaining the different types of food separate from each other while inhibiting liquids from the container 10.

One other feature of the present invention is to configure the dividers 60, 62 with a recess 100 defining a seat 102 and side walls 104 for receiving and holding an item such as a cup of gravy or souffle externally of the cover 14. When the cover 14 is divided into three separate compartments as shown in the illustrated embodiment, an internal divider wall of each compartment defines the side wall 104 of the recess 100.

The plate 12 and cover 14 are preferably manufactured from a resilient plastic material, although other inexpensive, disposable materials such as paper, polystyrene foam, or other thermoplastic foams can be used. The plate 12 and cover 14 can also be manufactured from a more durable type of material for providing a reusable container if desired. Preferably, the cover 14 is transparent for making it possible to observe the contents of an assembled container 10. Also preferably, the thickness of the walls of the plate 12 is less than 0.018 millimeters, and the total weight of the plate 12 is less than 26 grams. Notably, the flats 34, 36 at the radial extremities of the dividers 30, 32 further serve to add to the structure and rigidity of the plate 12 without requiring additional material or thickness. Thus, a lightweight plate 12 is provided which maintains the desired rigidity to carry full meals without flexing or otherwise failing during transport. The wall thickness and weight of the cover 14 can be even less than those dimensions for the plate 12 because the cover 14 is not a load-bearing component of the container 10. However, it is desirable to make the height of the cover 14 great enough to accommodate relatively generous portions of food such as a half-chicken.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A two-piece container comprising:

a plate having a peripheral rim;

a cover having a peripheral flange with a depending portion adapted to overlappingly engage said peripheral rim of the plate in a releasable interlocking relationship;

an indexing cut-out portion, said indexing cut-out portion being crescent-shaped with opposing radial side edges and formed in one of the peripheral rim of the plate and the peripheral flange of the cover; and an indexing protrusion extending inwardly from the other of said peripheral rim of the plate and the peripheral flange of the cover, said indexing protrusion including a pair of spaced apart projections each adapted to engage a respective side edge of the indexing cut-out portion to thereby facilitate alignment of the cover and the plate during releasable attachment of the cover to the plate.

2. The container of claim 1 wherein the cut-out portion is formed in the peripheral rim of the plate, and the spaced apart projections extend inwardly from the depending portion of the cover peripheral flange.

3. The container of claim 2 wherein the projections are generally V-shaped, each projection having an inner and outer wall.

4. The container of claim 3 wherein the inner wall of each projection extends outwardly past the depending portion of the cover peripheral edge to form part of a hollow pull-tab.

5. The container of claim 4 wherein the pull-tab further comprises a front wall and a top wall, the top wall being at an elevation higher than the peripheral flange of the cover to allow additional space for the finger of a person applying an upward pressure to the peripheral flange of the cover, thereby facilitating loosening and removal of the cover.

6. A two-piece compartmental container, comprising:

a plate having a bottom, a side wall extending upwardly from a periphery of said bottom, a peripheral rim extending outwardly from the periphery of the side wall and having a raised outermost ridge, and a plurality of raised rib-like partitions extending upwardly from said bottom to define separate plate compartments for holding and separating food items thereon, said partitions having an inverted substantially hollow V-shape with rounded apexes, and said peripheral rim having an indexing cut-out portion formed therein;

a cover having a peripheral flange with a raised outermost recess matingly engageable with the raised outermost ridge of the peripheral rim of the plate and a depending portion adapted to overlappingly engage said peripheral rim in a releasable interlocking relationship, said cover having a top wall provided with a plurality of depending dividers for dividing the cover into separate compartments complementary to said compartments defined in the plate, said dividers extending a sufficient distance to engage the plate partitions when the cover is attached to the plate to thereby define separate food compartments, wherein the dividers are generally V-shaped with apexes defining a channel adapted to receive and mate with the rounded apexes of the partitions, thereby inhibiting liquid from transferring between the food compartments; and a hollow pull-tab extending outwardly from the depending portion of the peripheral flange of the cover, said hollow pull-tab configured with sufficient space to receive the finger of a person applying an upward pressure to the peripheral flange of the cover to thereby facilitating loosening and removal of the cover, and said pull-tab configured to engage the indexing cut-out portion in the rim of the plate to thereby facilitate alignment of the cover and the plate during releasable attachment of the cover to the plate.

7. A two-piece container comprising:

a plate having a peripheral rim;

a cover having a peripheral flange with a depending portion adapted to overlappingly engage said peripheral rim of the plate in a releasable interlocking relationship;

an indexing cut-out portion formed in the peripheral rim of the plate, said cut-out portion being crescent-shaped with opposing radial side edges;

a hollow pull-tab extending outwardly from the depending portion of the peripheral flange of the cover and having side walls extending inwardly past the depending portion of the cover peripheral flange, the juncture of the pull-tab side walls and said depending portion defining a pair of spaced apart recesses adapted to engage the side edges of the cut-out portion to thereby facilitate alignment of the cover and the plate during releasable attachment of the cover to the plate; and said hollow pull-tab configured with sufficient space to receive therein the finger of a person applying an upward pressure to the peripheral flange of the cover to thereby facilitate loosening and removal of the cover.

8. The container of claim 7 wherein the recesses are generally V-shaped.

9. A two-piece container comprising:

a plate having a peripheral rim;

a cover having a peripheral flange with a depending portion adapted to overlappingly engage said peripheral rim of the plate in a releasable interlocking relationship;

an indexing cut-out portion formed in the peripheral rim of the plate;

a hollow pull-tab extending outwardly from the depending portion of the peripheral flange of the cover and including a front wall, a top wall, a rear wall and side walls, said top wall being at an elevation higher than the peripheral flange of the cover, and said rear wall terminating adjacent a rear edge of the cut out; and said hollow pull-tab configured with sufficient space to receive therein the finger of a person applying an upward pressure to the peripheral flange of the cover to thereby facilitate loosening and removal of the cover, and said pull-tab configured to engage the indexing cut-out portion in the rim of the plate to thereby facilitate alignment of the cover and the plate during releasable attachment of the cover to the plate.

* * * * *